US006935888B2

(12) United States Patent
Huang

(10) Patent No.: US 6,935,888 B2
(45) Date of Patent: Aug. 30, 2005

(54) ELECTRICAL CONNECTOR FOR FLAT CABLE

(75) Inventor: Chien-Hsun Huang, Tu-Chen (TW)

(73) Assignee: Hon Hai Precision Ind. Co. LTD, Taipei Hsien (TW)

( * ) Notice: Subject to any disclaimer, the term of this patent is extended or adjusted under 35 U.S.C. 154(b) by 0 days.

(21) Appl. No.: 10/815,381

(22) Filed: Mar. 31, 2004

(65) Prior Publication Data

US 2004/0219826 A1 Nov. 4, 2004

(30) Foreign Application Priority Data

Apr. 30, 2003 (TW) ..... 92206971 U

(51) Int. Cl.[7] ..... H01R 12/24
(52) U.S. Cl. ..... 439/495; 439/260
(58) Field of Search ..... 439/260, 326, 439/492, 495

(56) References Cited

U.S. PATENT DOCUMENTS 6,089,905 A * 7/2000 Shimmyo et al. ..... 439/495
6,099,346 A * 8/2000 Hashiguchi et al. ..... 439/495
6,471,541 B2 * 10/2002 Kunishi et al. ..... 439/495
6,514,101 B1 * 2/2003 Miura ..... 439/495
6,533,606 B2 * 3/2003 Yamane ..... 439/495
6,551,128 B2 * 4/2003 Asai ..... 439/495
6,561,843 B1 5/2003 Ma et al.

FOREIGN PATENT DOCUMENTS

| | | |
|---|---|---|
| JP | 8-279378 | 10/1996 |
| JP | 2814447 | 8/1998 |
| JP | 3008157 | 12/1999 |
| JP | 3160665 | 2/2001 |
| JP | 3378990 | 12/2002 |

* cited by examiner

*Primary Examiner*—Thanh-Tam Le
(74) *Attorney, Agent, or Firm*—Wei Te Chung

(57) ABSTRACT

An FPC connector (10, 10') comprises a housing (20, 20') and a pressing member (30, 30') mounted on the housing rotatable from an open position to a closed position. The housing defines a pair of posts (28*a*, 28*a'*) each having a protruding hook (208, 280') and a pair of notches (24*a*) each having first and second slanted surfaces (244, 242). A resilient portion (24*b*) is defined at one side of each notch. The pressing member has a pressing body (32, 32') having shafts (36*a*) and L-shaped resilient arms (34*a*, 34*a'*). The isolated portions and the first and second slanted facilitate the insertion of the shafts into the notches. The L-shaped resilient arms (34*a*, 34*a'*) are provided to engage the protruding hooks of the posts to lock the pressing member at the closed position.

15 Claims, 6 Drawing Sheets

ELECTRICAL CONNECTOR FOR FLAT CABLE

BACKGROUND OF THE INVENTION

1. Field of the Invention

The present invention relates to electrical connectors, and more particularly to a flexible printed circuit (FPC) connector for electrically interconnecting a printed circuit board (PCB) with an electrical interface such as a flexible printed circuit (FPC) board.

2. Description of the Prior Art

FPC connectors are commonly applied for electrical engagement between PCBs and FPC boards. A typical FPC connector of this kind comprises a housing, a plurality of terminals received in the housing, and a pressing member slidably mounted on the housing. Each terminal has a bifurcated contact section, and a solder tail for being soldered onto a PCB board. One end of an FPC board is inserted into an opening defined in the housing, said end thereby engaging with the contact sections of the terminals. Thus, mechanical and electrical engagement between the PCB and the FPC board is attained.

The pressing member of some FPC connectors, such as that disclosed in U.S. Pat. No. 6,561,843, is not rotatable relative to the housing of the FPC connector. Instead, the pressing member is inserted into an opening of the housings along a single direction parallel to an associated PCB. With the trend toward more and more miniaturization of structures of the FPC connectors, it is becoming increasingly difficult for assemblers and users to insert and extract a pressing member into and from a corresponding opening of an FPC connector.

Japan Patent numbers 3,008,157, 3,378,990 and 2,814,447 disclose another kind of FPC connector. The connector has a structure similar to that of U.S. Pat. No. 6,561,843, except that the pressing member is pivotally mounted on the housing, so that the pressing member is rotatable from an open position to a closed position relative to the housing. However, there is no retention means incorporated in the pressing member or the housing of the FPC connector. When the pressing member or the housing is accidentally bumped, the actuating member is prone to rotate upwardly away from the closed position. When this happens, mechanical and electrical engagement between the FPC board and terminals of the FPC connector is destabilized. Open circuits may even occur between some terminals and the inserted end of the FPC board.

In order to overcome the above-mentioned problems, Japan Patent number 3,160,665 discloses still another FPC connector. A pair of first protruding blocks extends from a front of a housing of the FPC connector, at tops of opposite side walls thereof. A pair of second protruding blocks is formed at opposite ends of a pressing member of the FPC connector, corresponding to the first protruding blocks. When an FPC board is inserted into the FPC connector, the first protruding blocks ride over and engage with the second protruding blocks. The pressing member is thereby locked at the closed position.

However, during the above-described process, the first and second protruding blocks undergo considerable interfering forces therebetween. This is because there are no spring or resilient means incorporated in the first and second protruding blocks. As a result, the first and second protruding blocks are liable to sustain damage, which may lead to the pressing member and/or the housing having to be discarded.

To reduce the large interfering forces, first and second protruding blocks with reduced interfering dimensions have been devised. Nevertheless, after repeated mating, the interfering dimensions tendto be even further reduced due to friction wear. When this happens, the first protruding blocks only loosely engage with the second protruding blocks, and the FPC board is not firmly retained in the housing. Thus, reliability of mechanical and electrical engagement between the FPC board and the terminals is decreased. Japan patent publication number 8-279378 has this kind of shortcoming.

What is needed is a new electrical connector that overcomes the above-mentioned problems.

SUMMARY OF THE INVENTION

An object of the present invention is to provide an FPC connector that is able to be conveniently assembled and that provides stably mechanical and electrical engagement between a PCB and an FPC board.

To fulfill the above object, an FPC connector according to the present invention is applied, and comprises a housing, a plurality of terminals received in the housing, and a pressing member pivotally mounted on the housing rotatable from an open position to a closed position. The housing defines two opposite side walls and an opening between the side walls for receiving an end of the flat cable. A notch is defined in each side wall, with first and second slanted guiding surfaces at a mouth thereof. An isolated part is formed at one lateral side of the notch, and is resiliently deformable relative to the other lateral side of the notch. An ear portion extends outwardly from each side wall, a post is formed on the ear portion, and has a protruding portion.

The pressing member comprises an elongated pressing body. A pair of operating members and a pair of positioning members are formed on opposite ends of the pressing body. The positioning members each have a shaft for being inserted in a corresponding notch of the housing. During the insertion, the first and second slanted guiding surfaces of the housing facilitate guiding the insertion of the shafts. Meanwhile, the isolated parts of the housing resiliently deform to allow the shafts to fall in the notches, the pressing member is thereby conventionally assembled onto the housing. Furthermore, the operating members each have an L-shaped resilient arm for resiliently mating with a corresponding protruding portion of the post of the housing, to thereby lock the pressing member at the closed position. Thus, stability of mechanical and electrical engagement between the FPC board and the terminals is attained.

Other objects, advantages and novel features of the present invention will become more apparent from the following detailed description when taken in conjunction with the accompanying drawings, in which:

DESCRIPTION OF PREFERRED EMBODIMENTS OF THE INVENTION

Reference will now be made to the drawings to describe the present invention in detail.

Figure 1:
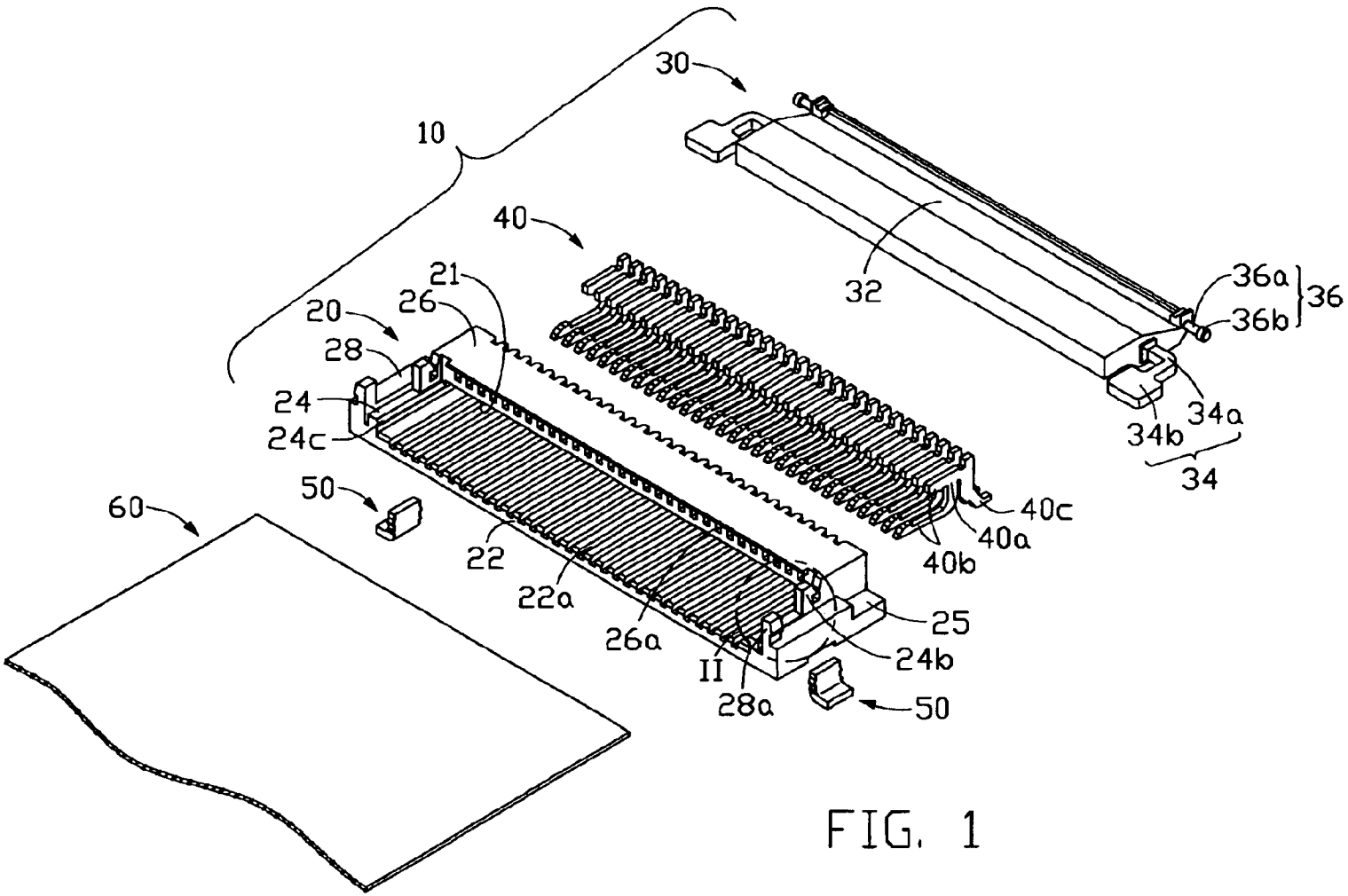
FIG. 1 is an exploded, isometric view of an FPC connector according to a preferred embodiment of the present invention, together with an FPC board ready to be inserted into the FPC connector.

FIG. 1 shows an exploded, isometric view of a flexible printed circuit (FPC) connector 10 according to the preferred embodiment of the present invention, together with an FPC board 60 for insertion into the FPC connector 10. The FPC connector 10 comprises an elongate housing 20, a plurality of terminals 40 received in the housing 20, a pressing member 30 pivotally mounted on the housing 20, and a pair of metal ears 50 retained in bottoms of opposite ends of the housing 20. The metal ears 50 are soldered on a printed circuit board (PCB) (not shown), to thereby mount the FPC connector 10 on the PCB.

The housing 20 is unitarily molded from dielectric material such as plastic or the like. The housing 20 has a bottom floor 22, and a top ceiling 26 above a rear part of the bottom floor 22. A plurality of parallel slots 22*a* is defined in a top of the bottom floor 22. A plurality of passages 26*a* is defined in the top ceiling 22, corresponding to the slots 22*a* of the bottom floor 22. The slots 22*a* and the passages 26*a* cooperatively receive corresponding terminals 40. The housing 20 further defines an elongate opening 21 between the bottom floor 22 and the top ceiling 26, for receiving an inserted end of the FPC board 60 that engages with the terminals 40. A pair of step-shaped side walls 24 is formed at opposite ends of the opening 21. An elongated rib 24*c* is formed on an inner side of each side wall 24, for guiding insertion of the FPC board 60 into the opening 21 along a direction parallel to the PCB.

Figure 2:
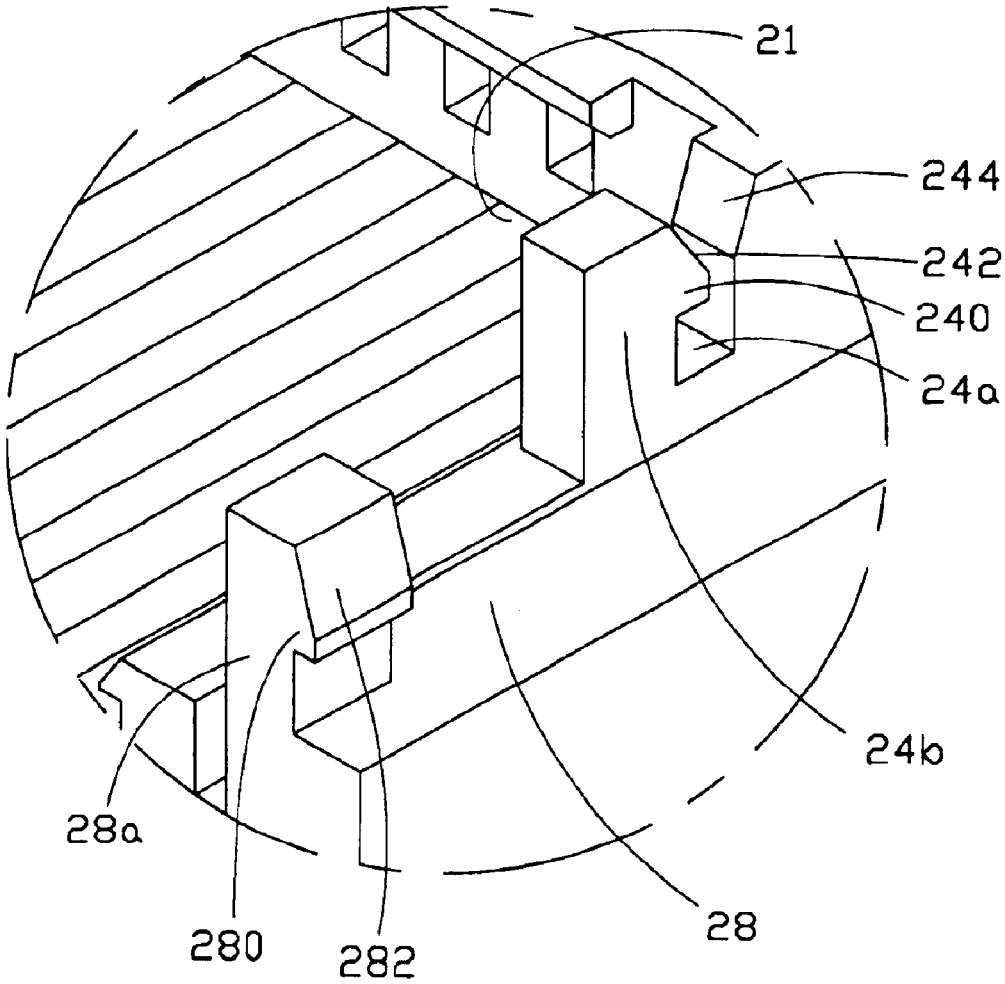
FIG. 2 is an enlarged view of a circled portion II of FIG. 1.

Referring also to FIG. 2, a notch 24*a* is defined in a top of each side wall 24. An isolated part 24*b* is formed at a front side of the notch 24*a*, and is resiliently deformable relative to the side wall 24. A protruding portion 240 is formed on a top of the isolated part 24*b*, extending into the notch 24*a*. A second slanted guiding surface 242 is formed on the protruding portion 240 adjacent the notch 24*a*. A first slanted guiding surface 244 is formed on the top ceiling 26 adjacent the notch 24*a*, opposite from the second slanted guiding surface 242. The first and second slanted guiding surfaces 244, 242 cooperatively form a flared mouth, for facilitating insertion and positioning of the pressing member 30.

An ear portion 25 extends from an outside of each side wall 24 adjacent a bottom of the bottom floor 22. The ear portion 25 comprises a platform 28 parallel to and spaced from the corresponding side wall 24. A post 28*a* extends upwardly from a top front part of the platform 28. In the preferred embodiment of the present invention, a protruding hook 280 is formed outwardly from a top of the post 28*a*. The protruding hook 280 has an outwardly facing slanted face 282.

Each terminal 40 comprises a retention section 40*a*, a bifurcated contact section 40*b* extending from a front of the retention section 40*a*, and a tail section 40*c* extending from a bottom of a rear of the retention section 40*a*. Upper and lower branches of the contact section 40*b* are respectively received in a corresponding passage 26*a* and a corresponding slot 22*a* of the housing 20, with a front end of the lower branch protruding beyond a top surface of the bottom floor 26. The tail section 40*c* is exposed outside of the housing 20, and is flush with a bottom surface of the bottom floor 26 (see FIG. 5).

The pressing member 30 is rotatable between a first position in which it is oriented at a vertical open position relative to the bottom floor 26, and a second position in which it is oriented at a horizontal closed position relative to the bottom floor 26. The pressing member 30 has a generally elongate pressing body 32, for pressing and positioning the FPC board 60 in the opening 21 of the housing 20. A pair of positioning members 36 extends perpendicularly from opposite ends of a rear of the pressing body 32 respectively. Each positioning member 36 has a shaft 36*a*, and an enlarged portion 36*b* at a free end of the shaft 36*a*.

A pair of operating members 34 is formed on opposite ends of a middle of the pressing body 32 respectively. In the preferred embodiment of the present invention, each operating member 34 comprises an L-shaped resilient arm 34*a*, and a coplanar horizontal actuating handle 34*b* disposed at a free end of the resilient arm 34*a*. The resilient arm 34*a* comprises a first portion extending from the corresponding end of the pressing body 32, and a second portion interconnecting the first portion and the actuating handle 34*b* and being parallel to the corresponding end of the pressing body 32.

Figure 3:
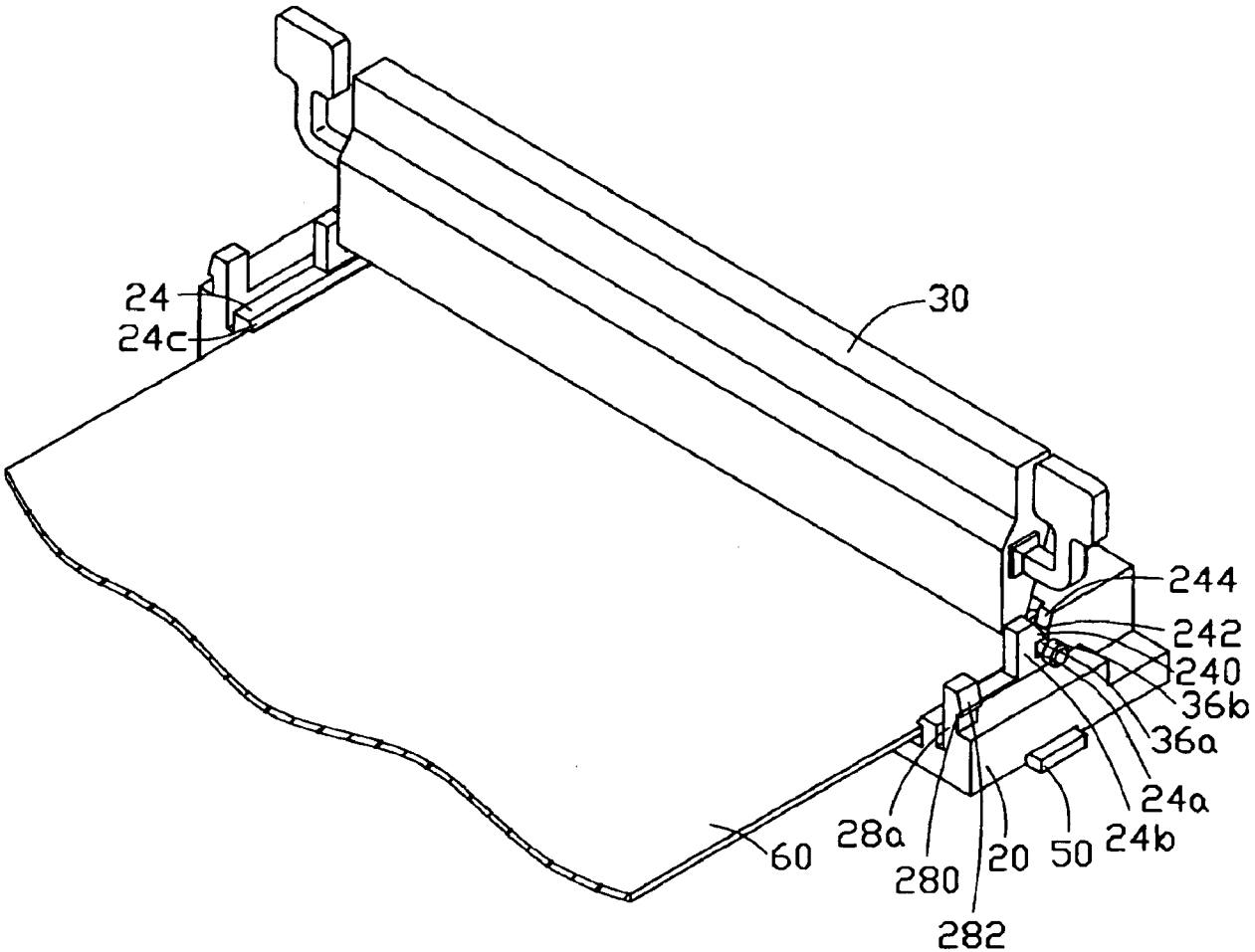
FIG. 3 is an assembled view of FIG. 1, showing a pressing member of the FPC connector oriented at an open position.

Referring to FIGS. 1, 2 and 3, in assembly, the terminals 40 are received in the housing 20, with the upper and lower branches of the terminals 40 being received in the corresponding passages 26*a* and the corresponding slots 22*a* of the housing 20. The pressing member 30 is vertically inserted into the housing 20, with the first and second slanted guiding surfaces 244, 242 of the mouths of the housing 20 guiding insertion of the shafts 36*a* of the positioning member 30 into the notches 24*a*. When the shafts 36*a* press the protruding portions 240, the isolated parts 24*b* of the housing 20 resiliently deform to allow the shafts 36*a* to be engaged in bottoms of the notches 24*a*. Once the shafts 36*a* are received in the bottoms of the notches 24*a*, the isolated parts 24*b* of the housing 20 rebound to their original states and thereby position the shafts 36*a* in the notches 24*a*. Thus, the pressing member 30 is attached on the housing 20. The enlarged portions 36*b* of the positioning member 30 have larger cross sections than the notches 24*a* of the housing 20. Thus when the shafts 36*a* are received in the notches 24*a*, the enlarged portions 36*b* engage with outsides of corresponding side walls 24 at the notches 24*a*, thereby preventing the pressing member 30 from moving laterally.

Figure 4:
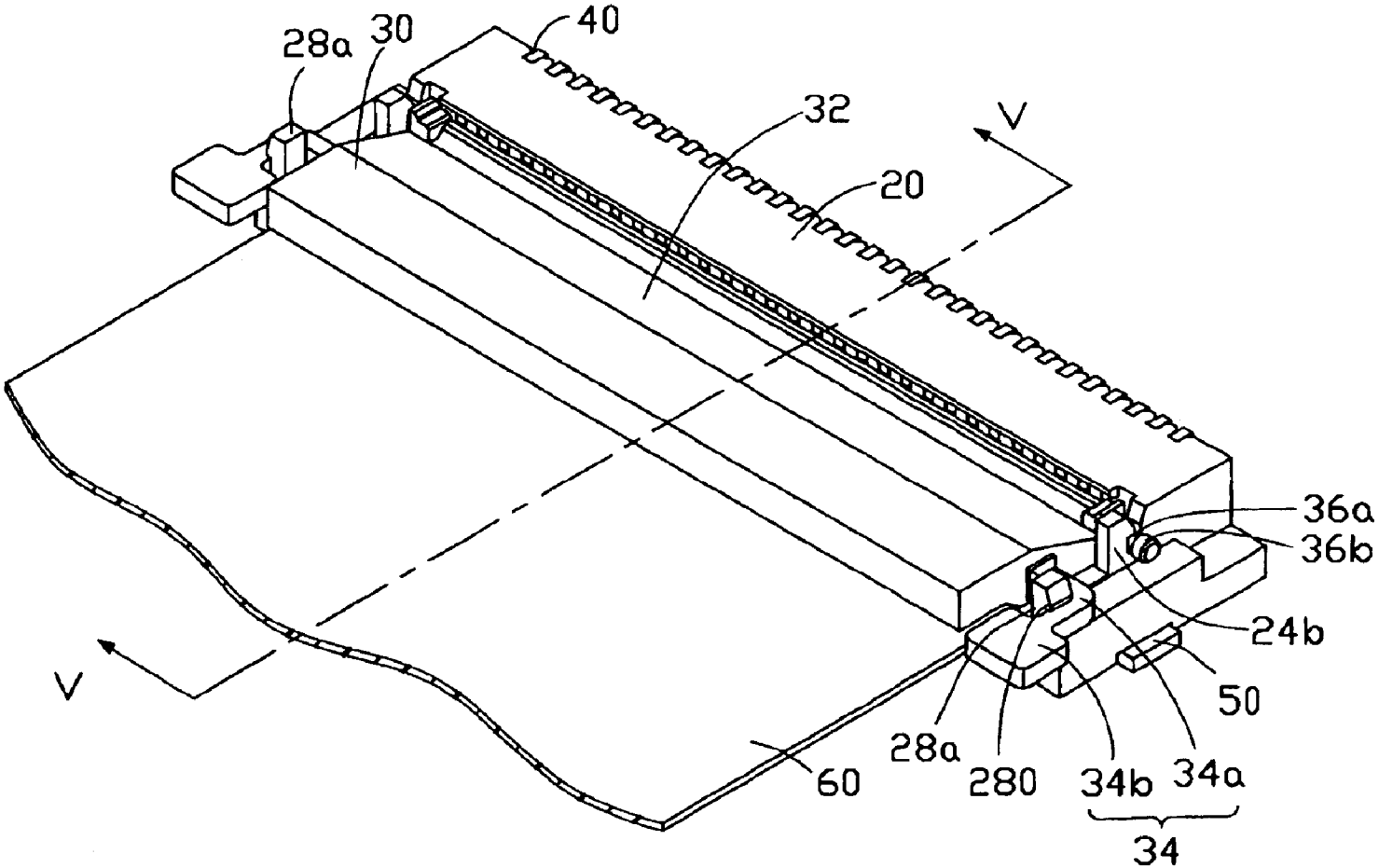
FIG. 4 is similar to FIG. 3, but showing the pressing member oriented at a closed position.
Figure 5:
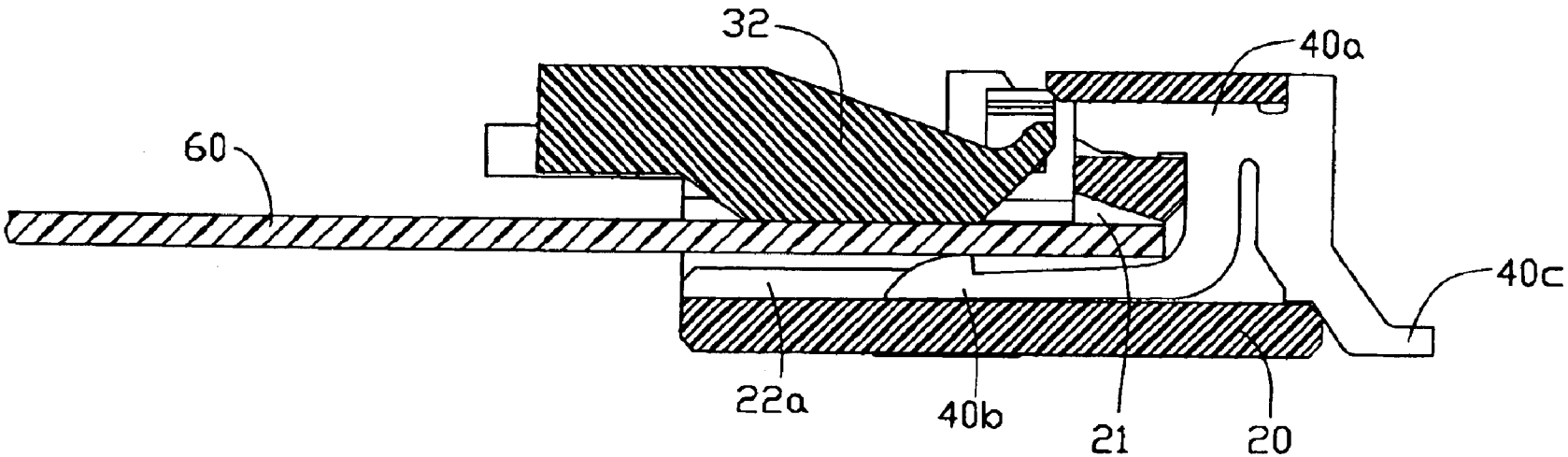
FIG. 5 is a cross sectional view taken along a line V—V of FIG. 4.

Referring to FIGS. 3, 4 and 5, in use, the FPC connector 10 is mounted on the PCB, with the tails of the terminals 40*c* and the metal ears 50 being soldered on the PCB. The pressing member 30 is rotated about axes of the shafts 36*a* thereof to the first position. The FPC board 60 is inserted into the opening 21 of the housing 20 with zero insertion force from a front of the housing 20. The ribs 24*c* of the housing 20 guide insertion of the FPC board 60 in the direction parallel to the PCB, to thereby assure uniform pre-contact between the FPC board 60 and the terminals 40. After that, by operating the actuating handles 34*b* of the operating members 34, the pressing member 30 is urged and rotated about said axes to the second position, in which the pressing body 32 presses the FPC board 60 to engage with the terminals 40. During such rotation, when the resilient arms 34*a* contact the posts 28*a*, the actuating handles 34*b* are manually pulled outwardly. The resilient arms 34*a* resiliently deform outwardly and ride over the protruding hooks 280. The protruding hooks 280 thereby hold the second portions of the resilient arms 34*a* at the second position. Thus the pressing member 30 is securely retained at the second position, and reliable electrical engagement between the PCB and the FPC board 60 is attained.

Additionally, the slanted faces 282 of the protruding hooks 280 guide the resilient arms 34*a* and help reduce excessive deformation of the resilient arms 34*a*. This makes the above operation more convenient and more reliable even after repeated usage.

In disassembly of the FPC board 60, the actuating handles 34*b* of the actuating members 40 are manually pulled outwardly and lifted up, so that the resilient arms 34*a* clear the protruding hooks 280. Then, the pressing member 30 is rotated about said axes to the first position, and the FPC board 60 is pulled out from the opening 21 with zero extraction force.

Accordingly, with the above-described configuration, the FPC board 60 is reliably engaged with the FPC connector 10 at the second position, and is conveniently and safely assembled and disassembled.

Figure 6:
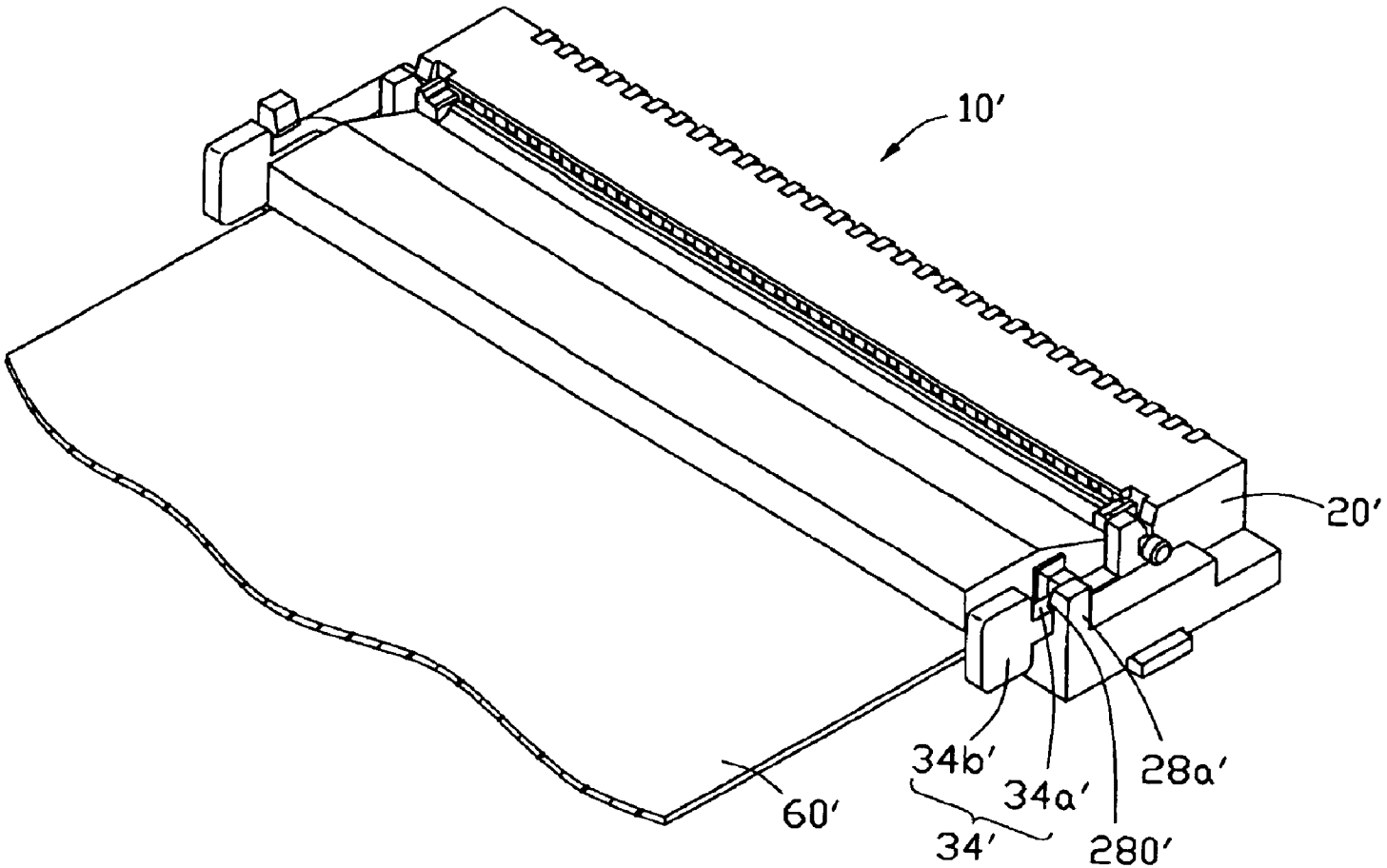
FIG. 6 is an isometric view of an FPC connector according to an alternative embodiment of the present invention, together with an FPC board inserted into the FPC connector.

In the above-described preferred embodiment, the actuating handles 34*b* of the operating members 34 are disposed at outsides of the posts 28*a*, with the protruding hooks 280 of the posts 28*a* facing outwardly. It should be understood that the operating members 34 and the posts 28*a* are not limited to such configurations, and may alternatively have other suitable configurations. For example, referring to FIG. 6, in an FPC connector 10' according to an alternative embodiment of the present invention, protruding posts 28*a*' have protruding hooks 280' facing inwardly. Actuating members 34' have vertical actuating handles 34*b*'. During insertion of an FPC board 60', the actuating handles 34*b*' are pressed inwardly to resiliently deform resilient arms 34*a*', and the resilient arms 34*a*' ride over the protruding hooks 280'. Thus the FPC board 60' is securely retained in an opening (not shown) of a housing 20'.

Further, although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector for a flat cable, comprising:

a dielectric housing mounting a plurality of terminals and defining two opposite side walls and an opening between the side walls for receiving an end of the flat cable in engagement with the terminals, the side walls each defining a notch with a flared mouth facing upwardly; and a pressing member pivotally mounted relative to the housing for movement between a first position allowing free insertion of the end of the flat cable into the opening and a second position where the pressing member abuts the flat cable against the terminals so as to assure mechanical and electrical engagement therebetween, the pressing member having a generally elongated pressing body and a pair of positioning members disposed at longitudinal opposite ends of the pressing body;

wherein a part of each of the side walls that is at one lateral side of the mouth is resiliently deformable to facilitate insertion of the positioning members into the corresponding notches as the pressing member is situated substantially at the second position and to assure pivotable reception of the positioning members in the notches;

wherein the each of the side walls defines first and second slanted guiding surfaces at the mouth of the notch thereof;

wherein the pressing body has two operating portions at opposite ends thereof; and wherein each of the operating portions has an L-shaped arm and a handle disposed at a free end of the arm.

2. The electrical connector of claim 1, wherein the housing has a bottom floor and a top ceiling at opposite sides of the opening of the housing.

3. The electrical connector of claim 2, wherein the bottom floor and the top ceiling each define passages for receiving corresponding terminals therein.

4. The electrical connector of claim 3, wherein each of the side walls of the housing forms a rib on an inner side thereof.

5. The electrical connector of claim 1, wherein each of the side walls of the housing forms an ear portion extending outwardly.

6. The electrical connector of claim 5, wherein the ear portion forms a positioning post, the positioning post having a hook portion with a slanted guiding surface.

7. An electrical connector for a flat cable, comprising:

a dielectric housing mounting a plurality of terminals and defining two opposite sides and an opening between the sides for receiving an end of the flat cable in engagement with the terminals, the sides each defining a positioning post; and a pressing member pivotally mounted relative to the housing for movement between a vertical position allowing free insertion of the flat cable into the opening and a horizontal position where the pressing member abuts the flat cable against the terminals to assure mechanical and electrical engagement therebetween, the pressing member having a generally elongated pressing body and a pair of operating members disposed at longitudinal opposite ends of the pressing body, each of the operating members having a resilient cantilever;

wherein the cantilever of each of operating members resiliently mates with a corresponding positioning post so as to facilitate positioning the pressing member at the horizontal position to assure mechanical and electrical engagement between the end of the flat cable and the terminals;

wherein the each of the side walls defines a notch with a flared mouth facing upwardly; and wherein the each of the side walls defines first and second slanted guiding surfaces at the mouth thereof, a part of the each of the side walls that is at one lateral side of the mouth thereof is resiliently deformable relative to the other lateral side of the mouth.

8. The electrical connector of claim 7, wherein each positioning post defines a protruding portion at a top end thereof, the protruding portion having a slanted surface.

9. The electrical connector of claim 7, wherein the housing has a bottom floor and a top ceiling at opposite sides of the opening of the housing.

10. The electrical connector of claim 9, wherein the bottom floor and the top ceiling each define passages for receiving corresponding terminals therein.

11. The electrical connector of claim 10, wherein the housing further has two opposite side walls at opposite ends thereof.

12. The electrical connector of claim 11, wherein each of the side walls forms a rib on an inner surface thereof.

13. The electrical connector of claim 7, wherein the pressing body defines a pair of positioning members at longitudinal opposite ends thereof, each of the positioning members having an enlarged portion at a free end thereof.

14. An electrical connector for a flat cable, comprising:

a dielectric housing mounting a plurality of terminals and defining two opposite side walls and an opening between the side walls for receiving an end of the flat cable in engagement with the terminals; and a pressing member pivotally mounted relative to the housing for movement between a first position allowing free insertion of the end of the flat cable into the opening and a second position where the pressing member abuts the flat cable against the terminals so as to assure mechanical and electrical engagement therebetween, the pressing member having a generally elongated pressing body with a pair of positioning members and a pair of operation members disposed at longitudinal opposite ends of the pressing body, the positioning members defining a pivotal axis while the operation members latching the pressing member in a fixed position relative to the housing;

wherein the housing defines two opposite elongated ribs on two opposite side walls so as to guide horizontal insertion of the flat cable into the housing, and said two opposite elongated ribs commonly define a passage therebetween to allow said pressing member to pass during rotation of said pressing member from an open position to the fixed position;

wherein the each of the side walls defines a notch with a flared mouth facing upwardly;

wherein the each of the side walls defines first and second slanted guiding surfaces at the mouth thereof, a part of the each of the side walls that is at one lateral side of the mouth is resiliently deformable to facilitate insertion of the positioning members into the corresponding notches as the pressing member is situated substantially at the second position and to assure pivotable reception of the positioning members in the notches; and wherein each of the operating portions has an L-shaped arm and a handle disposed at a free end of the arm.

15. The connector of claim 14, wherein said pair of operation members are essentially located outside of said pair of elongated ribs in a longitudinal direction of the housing.

* * * * *